US009254545B2

(12) United States Patent
Park

(10) Patent No.: US 9,254,545 B2
(45) Date of Patent: Feb. 9, 2016

(54) POLISHING APPARATUS, POLISHING PAD, AND POLISHING INFORMATION MANAGEMENT SYSTEM

(75) Inventor: Jaehong Park, Kyoto (JP)

(73) Assignee: Nitta Haas Incorporated, Osaka (JP)

( * ) Notice: Subject to any disclaimer, the term of this patent is extended or adjusted under 35 U.S.C. 154(b) by 484 days.

(21) Appl. No.: 13/634,705

(22) PCT Filed: Mar. 9, 2011

(86) PCT No.: PCT/JP2011/001379

§ 371 (c)(1),
(2), (4) Date: Sep. 13, 2012

(87) PCT Pub. No.: WO2011/114658

PCT Pub. Date: Sep. 22, 2011

(65) Prior Publication Data

US 2013/0052917 A1 Feb. 28, 2013

(30) Foreign Application Priority Data

Mar. 19, 2010 (JP) ..... 2010-063699

(51) Int. Cl.

| | |
|---|---|
| ***B24B 37/20*** | (2012.01) |
| ***B24B 49/10*** | (2006.01) |
| ***B24B 37/005*** | (2012.01) |
| ***B24B 37/015*** | (2012.01) |

(52) U.S. Cl.

CPC ..... *B24B 37/20* (2013.01); *B24B 37/005* (2013.01); *B24B 37/015* (2013.01); *B24B 49/10* (2013.01)

(58) Field of Classification Search

None

See application file for complete search history.

(56) References Cited

U.S. PATENT DOCUMENTS

| | | | | |
|---|---|---|---|---|
| 2006/0014475 | A1* | 1/2006 | Sekiya | 451/5 |
| 2007/0235133 | A1 | 10/2007 | Benassi | |
| 2008/0004743 | A1* | 1/2008 | Goers et al. | 700/121 |
| 2009/0053983 | A1* | 2/2009 | Hosaka et al. | 451/527 |

FOREIGN PATENT DOCUMENTS

| | | | |
|---|---|---|---|
| CN | 101157197 | A | 4/2008 |
| JP | 08-220949 | A | 8/1996 |
| JP | 2006-004992 | A | 1/2006 |
| JP | 2006-315137 | A | 11/2006 |
| JP | 2008-049448 | A | 3/2008 |
| JP | 2008-93735 | A | 4/2008 |
| JP | 2008-229828 | A | 10/2008 |
| JP | 2009-531862 | A | 9/2009 |
| TW | 200802577 | A | 1/2008 |

OTHER PUBLICATIONS

International Search Report issued in International Application No. PCT/JP2011/001379 issued Apr. 26, 2011.

* cited by examiner

*Primary Examiner* — Sean Shechtman

(74) *Attorney, Agent, or Firm* — McDermott Will & Emery LLP

(57) ABSTRACT

A polishing pad has structural parts embedded therein; sensors, a memory for storing detected information obtained by the sensors, and a communication unit driven by a power supply unit to communicate with outside in a non-contact manner. The polishing pad and a communication unit configured to communicate with the communication unit of the polishing pad in a non-contact manner constitute a polishing information management system. The polishing pad and a communication unit configured to transmit and receive the information to and from the communication unit of the polishing pad in a non-contact manner constitute a polishing apparatus.

4 Claims, 3 Drawing Sheets

POLISHING APPARATUS, POLISHING PAD, AND POLISHING INFORMATION MANAGEMENT SYSTEM

RELATED APPLICATIONS

This application is the U.S. National Phase under 35 U.S.C. §371 of International Application No. PCT/JP2011/001379, filed on Mar. 9, 2011, which in turn claims the benefit of Japanese Application No. 2010-063699, filed on Mar. 19, 2010, the disclosures of which Applications are incorporated by reference herein.

FIELD OF THE INVENTION

The present invention relates to a polishing apparatus used to polish semiconductor wafers, mostly silicon wafers, a polishing pad used in the polishing apparatus, and a polishing information management system.

DESCRIPTION OF THE RELATED ART

In the field of semiconductor manufacturing, it is today an indispensable technique to flatten semiconductor wafers to keep abreast of increasingly higher integration of semiconductor apparatuses. A typical example of the flattening technique is CMP (Chemical Mechanical Polishing).

A conventional CMP polishing apparatus puts an upper press platen retaining thereon a wafer on a lower press platen with a polishing pad set thereon and makes the wafer and the polishing pad slidably move relative to each other under an applied pressure while supplying slurry to between the wafer and the polishing pad to polish the wafer (for example, see the Patent Reference 1).

PRIOR ART DOCUMENT

Patent Reference

Patent Reference 1: JP Patent Application Publication No. 2008-49448

SUMMARY OF THE INVENTION

Problems to be Solved by the Invention

The CMP polishing by the polishing apparatus may be an unstable process because of conditions of the ongoing polishing process (specifically, temperature of an object to be polished, pressure to be applied, and speed of rotation) constantly changing under the influence of interactions between structural elements provided in the apparatus.

During the polishing of a wafer, for example, an overall temperature of the wafer may increase or a temperature distribution of the wafer may become uneven because of, for example, heat of friction between the wafer to be polished, the polishing pad, and abrasive grains of the slurry, and heat generated by chemical reactions of the slurry.

During the polishing process, it is necessary to monitor such conditions of the ongoing polishing process in order to predict a polishing outcome of the polishing-completed object and accordingly adjust operational requirements of the polishing apparatus to serve the purpose of the polishing process, thereby ensuring a good polishing reproducibility.

To monitor the conditions such as the temperature of the object to be polished, however, it is necessary to additionally provide a dedicated detector in the polishing apparatus, leading to a complicated structure of the apparatus and cost increase.

A conventional approach for detecting the temperature of the object to be polished is to embed temperature sensors in the polishing pad (for example, see the Patent Reference 1). Though such a polishing pad can directly detect the temperature of the object to be polished, it is necessary to further provide a slip ring to fetch detection signals of the temperature sensors. This approach too inevitably complicates the apparatus structure.

To solve the conventional problems, an object of the invention is to retrieve information notifying of conditions of an ongoing polishing process without adding any device to a polishing apparatus that may structurally complicate the polishing apparatus.

The adjustment of the operational requirements of the polishing apparatus needs information of the specific operational requirements, in addition to a) information notifying of conditions of the ongoing polishing process, b) material resin, processing temperature, and manufacturing history (material history) of the polishing pad, and c) speed of rotation and pressure to be applied during the polishing.

The manufacturing history in b) can be obtained by accessing a product database, and the information in c) can be obtained from the polishing apparatus. The informations a), b), and c), which are necessary data to adjust the operational requirements of the polishing apparatus, are thus obtained by accessing different information sources, which is time-consuming. This makes it difficult to adjust the operational requirements of the polishing apparatus, failing to ensure a good polishing reproducibility.

Another object of the invention is, therefore, to accomplish collective management of all of informations needed to adjust operational requirements of a polishing apparatus, so that the operational requirements are adjusted and a good polishing reproducibility is ensured in a facilitated manner.

Means for Solving the Problem

A first aspect of the invention achieves the objects of the invention by focusing on a polishing pad. A polishing pad according to the invention includes sensors, a memory for storing detected information obtained by the sensors, a power supply unit, and a communication unit configured to communicate with outside in a non-contact manner.

When the polishing pad thus characterized is set on a predefined part of a polishing apparatus and used for a polishing process, conditions of the ongoing polishing process, such as temperature, are detected by the sensors, and detected information is stored in the memory and transmitted outside by the communication unit. When an external communication device is provided to communicate with the communication unit, information notifying of the conditions of the ongoing polishing process is obtained in real time by the communication device.

The communication unit is preferably configured to perform communication in a non-contact manner, for example, through radio wave communication and electromagnetic induction.

The polishing pad preferably further includes an information storage module embedded therein, wherein the memory, the power supply unit, and the communication unit are provided in the information storage module.

When the memory, the power supply unit, and the communication unit are thus modularized, all of the embedded structural elements except the sensors are gathered in one device. This increases a degree of freedom in locating the sensors.

The polishing pad preferably further includes the sensors of at least one type to detect at least one of a temperature, a pressure, and a speed of rotation. The target to be detected is not necessarily limited to these elements. The sensors may detect a degree of friction or wear.

The memory of the polishing pad preferably stores therein a manufacturing history of the polishing pad and operational requirements of the polishing apparatus in addition to the detected information obtained by the sensors during the polishing process after the polishing pad is set in the polishing apparatus.

Of the data mentioned in the preceding section, the manufacturing history can be stored in the memory before the manufactured polishing pad is shipped. The operational requirements of the polishing apparatus may be transmitted from outside and stored in the memory through the communication unit when the polishing pad is set in the polishing apparatus.

After these informations are stored, all of the informations needed to adjust the operational requirements of the polishing apparatus are collected and stored in the memory. When these data stored in the memory are checked, analyses possibly required such as a polishing failure analysis, for example, can be facilitated as well as the adjustment of the operational requirements.

The polishing pad according to the invention preferably further includes a lifetime display unit, wherein the information storage module assesses a lifetime of the polishing pad based on the detected information stored in the memory and displays a result of the lifetime assessment on the lifetime display unit. According to the polishing pad, a user can accurately know the lifetime of the polishing pad.

A second aspect of the invention provides a polishing information management system. The polishing information management system includes the polishing pad according to the first aspect of the invention and a communication unit configured to communicate in a non-contact manner with the communication unit of the polishing pad.

According to the polishing information management system thus characterized, information notifying of the conditions of the ongoing polishing process can be retrieved directly from the polishing pad currently operating, and all of the data needed to adjust the operational requirements of the polishing apparatus can be transmitted from an external transmitter/receiver to the communication unit of the polishing pad and stored in the memory of the polishing pad. This facilitates the adjustment of the operational requirements.

A third aspect of the invention provides a polishing apparatus wherein an object to be polished retained on a lower surface of an upper press platen and a polishing pad set on a lower press platen are pushed against each other under an applied pressure and slidably moved relative to each other to polish the object. The polishing pad of the polishing apparatus is the polishing pad according to the first aspect of the invention. The polishing apparatus further includes a communication unit configured to perform communication in a non-contact manner with the communication unit of the polishing pad.

The polishing apparatus thus characterized can retrieve information notifying of the conditions of the ongoing polishing process in real time by simply providing therein the communication unit to communicate with the communication unit of the polishing pad. Further, the polishing apparatus can collectively store all of the informations needed to adjust the operational requirements of the polishing apparatus in the memory of the polishing pad.

Effect of the Invention

The invention can obtain information notifying of the conditions of the ongoing polishing process in real time without additionally providing a complicated technical means in a polishing apparatus. As a result, the operational requirements are adjusted and a good polishing reproducibility is ensured in a facilitated manner.

Moreover, all of the informations needed to adjust the operational requirements of the polishing apparatus are collected and stored in the memory of the polishing pad. Thereby, a uniform management of the information is attained. Such a uniform information management facilitates the adjustment of the operational requirements and analyses possibly required such as a polishing failure analysis.

MODES FOR CARRYING OUT THE INVENTION

Figure 1:
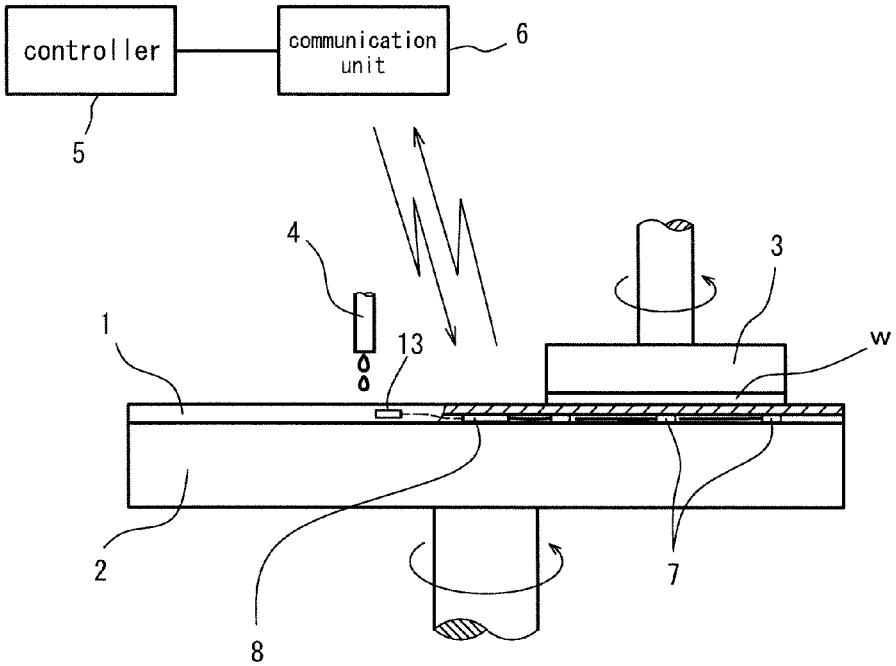
FIG. 1 is an illustration of a polishing apparatus according to an embodiment of the invention.

Hereinafter, a polishing apparatus according to an embodiment of the invention is described in detail referring to FIGS. 1 to 5. As illustrated in FIG. 1, the polishing apparatus according to the embodiment has a lower press platen 2 having an upper surface for a polishing pad 1 to be set thereon, an upper press platen 3 having a lower surface for a polishing object, wafer W, to be retained thereon, a slurry feed nozzle 4, and a controller 5.

The lower press platen 2 and the upper press platen 3 are rotated around a longitudinal axis by motors coupled with respective shaft portions and driven in tandem with each other. The upper press platen 3 is vertically movable. When the upper press platen 3 is moved downward, the wafer W retained on the lower surface thereof contacts the polishing pad 1 on the lower press platen 2 under an applied pressure. The feed nozzle 4 is provided on the lower press platen 2 to feed slurry on the polishing pad 1 on the lower press platen 2. The controller 5 controls the operations of the structural elements of the apparatus, the lower press platen 2, upper press platen 3, and feed nozzle 4.

In view of structural characteristics of the polishing pad 1 described later, the apparatus according to the embodiment is provided with a communication unit 6 configured for radio wave communication. The communication unit 6 is connected to the controller 5. A device constituting the communication unit 6 is, for example, an RF-ID reader/writer comparable to an RF-ID (wireless authentication) chip of the polishing pad 1.

The present embodiment is characterized by the polishing pad 1. Referring to the drawings, an upper surface of the polishing pad 1 is used as a polishing surface, and the polishing pad 1 includes sensors 7 embedded in a thickness dimension of the polishing surface and an information storage module 8 also embedded therein to which detected results outputted from the sensors 7 are inputted.

The sensors 7 are provided to detect conditions of an ongoing polishing process. The sensors 7 are, for example, temperature sensors, pressure sensors, or acceleration sensors for detecting rotation, and a target to be detected is not necessarily limited. The sensors 7 may be sensors of a type or a plurality of different types. The detected results outputted from the sensors 7 are inputted to the information storage module 8 through a lead wire.

Figure 2:
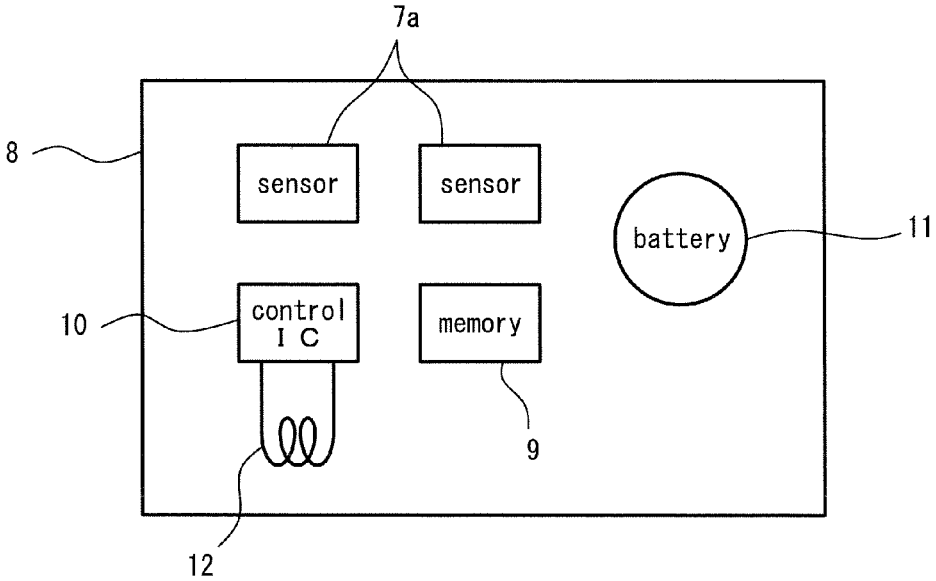
FIG. 2 is a block diagram illustrating an information storage module provided in a polishing pad of the polishing apparatus.

As illustrated in FIG. 2, the information storage module 8 has structural elements embedded therein; a memory 9, a control IC 10, a battery 11 as a power supply unit, and sensors 7*a*. For example, an RF-ID (wireless authentication) chip constitutes the information storage module 8.

The memory 9 is a readable and writable device and stores therein information detected by the sensors 7*a* provided in the information storage module 8 and the sensors 7 provided outside of the information storage module 8. Preferably, a manufacturing history of the polishing pad 1 (for example, product name, lot number, manufacturing date) is already written in the memory 9 after the manufacturing or before shipment of the polishing pad 8 provided with the information storage module 8. The memory 9 can further store therein information transmitted from the communication unit 6. When the operational requirement data of the polishing apparatus is transmitted from the communication unit 6, the data is stored in the memory 6. Of all of the informations to be stored, any detected data by each polishing process and the operational requirement data are stored in the memory 9 as illustrated in Table 1.

TABLE 1

| Operational Requirements/Detected Information | | | | | |
|---|---|---|---|---|---|
| process No. | rotation speed (RPM) | pressure (psi) | temperature (° C.) | friction (kgf) | polishing rate (μm) |
| 1 | 60 | 5 | 32.5 | 15.3 | 5 |
| — | — | — | — | — | — |
| 1200 | 60 | 5 | 43.2 | 19.7 | 7 |
| — | — | — | — | — | — |

The sensors 7*a* provided in the information storage module 8 may be of the same type as the sensors 7 provided outside of the information storage module 8. The sensors to be provided may be the outside sensors 7 alone, in which case the sensors 7*a* provided in the information storage module 8 are omitted.

The control IC 10 writes and reads information in and from the memory 9 and also transmits and receives data through radio wave by using an antenna 12 and the communication unit 6 of the polishing apparatus. The control IC 10 functions as a communication unit configured for non-contact communication. The control IC 10 reads the detected information of the sensors 7 stored in the memory 9 and transmits the read information to the communication unit 6 and also receives the information transmitted from the communication unit 6 to store the operational requirement data in the memory 9.

Figure 3:
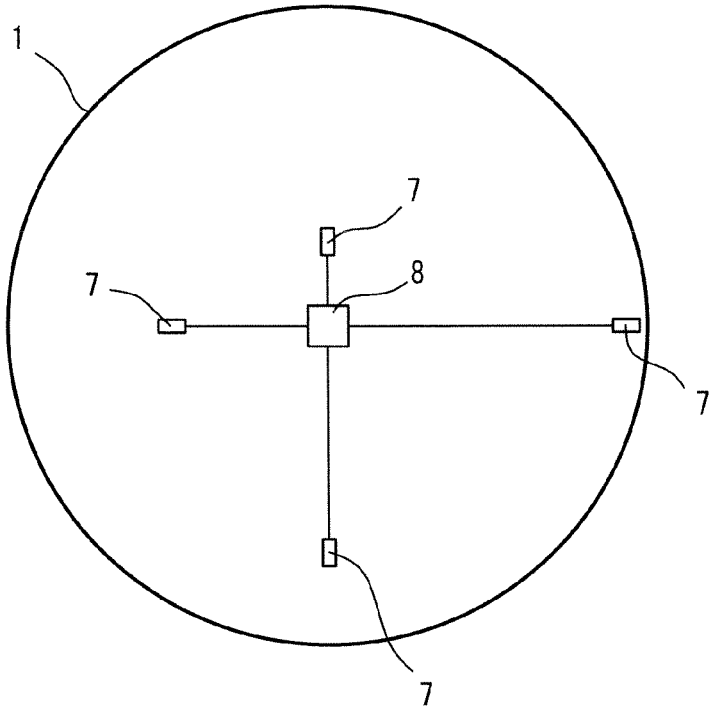
FIG. 3 is a layout drawing of structural parts of the polishing pad.
Figure 4:
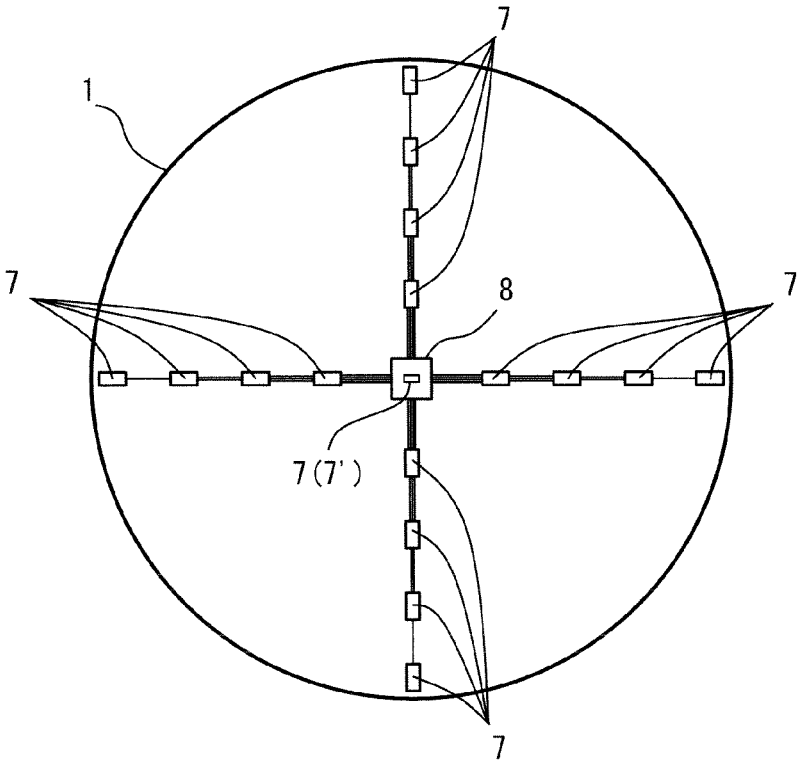
FIG. 4 is another layout drawing of structural parts of the polishing pad.

FIGS. 3 and 4 illustrate layout examples of the sensors 7 and the information storage module 8 in the polishing pad 1. In the example of FIG. 3, the information storage module 8 is provided at the center of a circular shape, and a plurality of (four) sensors 7 are provided at positions where a plurality of (four) lines equiangularly extending from the center intersect with a spiral drawn from the center. According to the layout, a relatively small number of sensors 7 can cover a polishing region on the surface of the polishing pad 1 without disturbing a rotational balance of the whole polishing pad 1.

In the example of FIG. 4, the information storage module 8 is provided at the center of a circular shape, and a plurality of sensors 7 are provided at radially equal intervals on a plurality of (four) lines equiangularly extending from the center. According to the layout, a large number of sensors 7 can cover the polishing region without disturbing the rotational balance of the whole polishing pad 1.

Referring to FIG. 4, the sensor located at the center of the circular shape may be the one 7*a* provided in the information storage module 8 or may be the one 7 provided separately from the information storage module 8 at positions overlapping the information storage module 8.

Though the information storage module 8 is desirably provided at the center of the polishing pad 1, the information storage module 8 are possibly provided at any portions but the center portion not directly participating in the polishing process unless the rotational balance is thereby disturbed, for example, peripheral portions of the polishing pad.

According to the description given so far, the communication unit 6 and the control IC 10 of the information storage module 8 provided in the polishing pad 1 transmit and receive information to and from each other through radio wave. However, these devices may transmit and receive information by electromagnetic induction. Whichever may be selected as far as the communication unit 6 and the communication unit of the information storage module 8 communicate with each other in a non-contact manner.

According to the description given so far, the polishing pad 1 is set on the lower press platen 2, and the semiconductor wafer W to be polished is set on the upper press platen 3 to start the polishing process. The sensors 7 embedded in the polishing pad 1 detect the conditions of the ongoing polishing process such as temperature, and the detected information is temporarily stored in the memory 9. In response to a request from the communication unit 6 or a spontaneous operation of the control IC 10, information notifying of the conditions of the ongoing polishing process stored in the memory 9 is transmitted to the communication unit 6. Accordingly, the controller 5 of the polishing apparatus can monitor the conditions of the ongoing polishing process in real time.

The manufacturing history of the polishing pad 1 is stored in advance in the memory 9 of the information storage module 8 of the polishing pad 1. To start the polishing process, data defined by the controller 5, such as the rotational speeds of the lower press platen 2 and the upper press platen 3 and the operational requirement data, for example, pressure to be applied to between the wafer W and the polishing pad 1, is transmitted from a transmitter/receiver 6 to the information storage module 8 of the polishing pad 1. Then, information notifying of the conditions of the ongoing polishing process and information needed to adjust the operational requirements of the polishing apparatus are all collected and stored in the memory 9 of the polishing pad 1. When the storage content of the memory 9 is read out, the operational requirements can be easily adjusted.

As described so far, the polishing pad 1 can collectively manage all of the informations needed to adjust the operational requirements of the polishing apparatus using the information storage module 8. Therefore, when, for example, a new polishing apparatus is purchased or an object to be polished is changed, the polishing pad 1 is used to adjust the operational requirements of the polishing apparatus. Accordingly, operational requirements suitable for an actual polishing process can be set in the polishing apparatus. After that, the polishing pad 1 is replaced with a polishing pad provided with neither of the sensors 7 nor the information storage module 8 but having a body identical to that of the polishing pad 1 to continue the polishing process.

According to the embodiment, the communication unit 6 is provided as a part of the polishing apparatus, however, the communication unit 6 is not necessarily provided as a structural element of the polishing apparatus. The communication unit 6 may be provided in a computer or a data processing apparatus independent from the polishing apparatus, in which case the communication unit 6 and the polishing pad 1 having the sensors 7 and the information storage module 8 constitute a system wherein all of the polishing-related informations are collectively managed.

The control IC 10 of the information storage module 8 calculates a lifetime of the polishing pad 1 based on the information stored in the memory 9 and notifies a user of a calculation result thereby obtained (whether an expected lifetime has been exhausted) by using a lifetime display unit (for example, LED lamp) 13. The control IC 10 calculates and notifies the lifetime of the polishing pad 1 as described below depending on types of the sensors 7 and 7*a*. The lifetime display unit 13 may be provided on a lateral surface of the polishing pad 1 as illustrated in FIG. 1 or may be provided outside of the polishing pad 1 (for example, controller 5).

Providing acceleration sensors as sensors 7 and 7*a*

The lifetime of the polishing pad 1 is assessed based on the finding that the polishing pad 1 in use is undergoing accelerations. The controller IC 10 counts up a total length of time when the accelerations equal to or larger than a given value are detected by the acceleration sensors 7 and 7*a* to thereby measure hours of use in total of the polishing pad 1, and stores a measurement result in the memory 9. Then, the controller IC 10 determines whether the stored hours of use in total are equal to or smaller than a predefined length of time (corresponding to the lifetime of the polishing pad 1). When the hours of use in total are determined as being equal to the predefined length of time, the controller IC 10 assesses that the lifetime of the polishing pad 1 has been used.

Providing Pressure Sensors as Sensors 7 and 7

The lifetime of the polishing pad 1 is assessed based on the finding that the polishing pad 1 in use is undergoing pressures. The controller IC 10 counts up a total length of time when the pressures equal to or larger than a given value are detected by the acceleration sensors 7 and 7*a* to thereby measure hours of use in total of the polishing pad 1, and stores a measurement result in the memory 9. The lifetime assessment based on the hours of use in total stored in the memory 9 is performed similarly to the description of the acceleration sensors.

Providing Temperature Sensors as Sensors 7 and 7

The lifetime of the polishing pad 1 is assessed based on the finding that the polishing pad 1 in use is undergoing temperature increases. The controller IC 10 counts up a total length of time when the temperatures equal to or larger than a given value are detected by the acceleration sensors 7 and 7*a* to thereby measure hours of use in total of the polishing pad 1, and stores a measurement result in the memory 9. The lifetime assessment based on the hours of use in total stored in the memory 9 is performed similarly to the description of the acceleration sensors.

The lifetime of the polishing pad 1 may be assessed based on the finding that the lower press platen 2 and the upper press platen 3 are rotating when the polishing pad 1 is in use. A wireless transmitter is provided in one of a rotation controller (not illustrated in the drawings) of the lower press platen 2 and a rotation controller (not illustrated in the drawings) of the upper press platen 3, and a wireless receiver (not illustrated in the drawings) is provided in the control IC 10. The control IC 10 detects the polishing process of the polishing pad 1 based on rotation-drive information received from the lower press platen 2 or the upper press platen 3 and counts up a total length of time when the polishing process is detected to thereby measure hours of use in total of the polishing pad 1, and stores a measurement result in the memory 9. The lifetime assessment based on the hours of use in total stored in the memory 9 is performed similarly to the description of the acceleration sensors.

According to the embodiment described so far, the sensors 7 and 7*a* detect a part of the current conditions of the polishing pad 1 (temperature, pressure, acceleration). The sensors 7 and 7*a* may detect current conditions of the whole surface the polishing pad 1. An example of such a sensor is a pressure sensing sheet. The pressure sensing sheet includes, for example, polymer cells having piezo characteristics. When the pressure sensing sheet large enough to cover the whole surface of the polishing pad 1 is provided in the polishing pad 1, variability of a pressure distribution on the whole surface of the polishing pad 1 can be detected in real time.

The plurality of sensors 7 and 7*a* may be sensors of a type or sensors of a plurality of different types (for example, acceleration sensors and pressure sensors). By thus combining the sensors of different types, the conditions of the ongoing polishing process can be more accurately detected by analyzing the different informations in a comprehensive manner.

Figure 5:
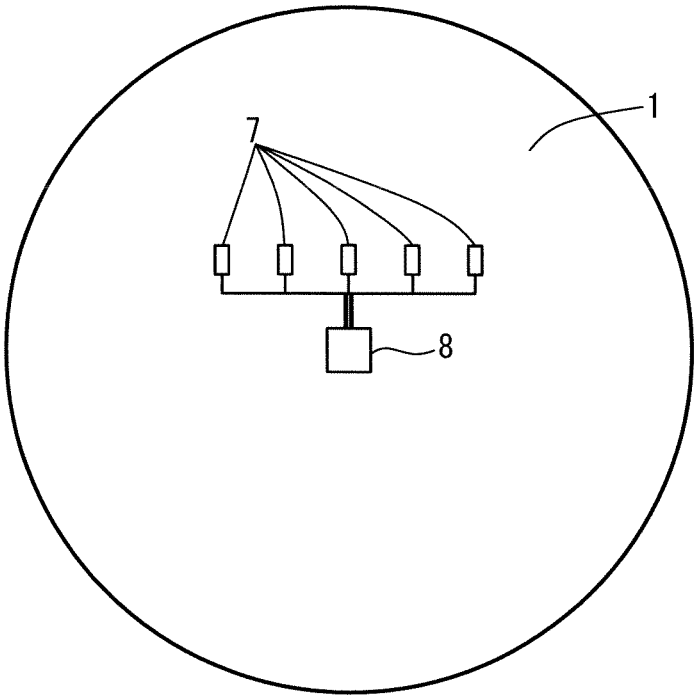
FIG. 5 is still another layout drawing of structural parts of the polishing pad.

The layout of the sensors when the plural sensors 7 and 7*a* are provided is not necessarily limited to the layouts illustrated in FIGS. 3 and 4. As illustrated in FIG. 5, the sensors may be linearly provided (linearly along a tangential line of the polishing pad 1 in FIG. 5).

INDUSTRIAL APPLICABILITY

The invention provides an advantageous technology particularly for a polishing apparatus which polishes a semiconductor wafer such as a silicon wafer, a polishing pad used in the polishing apparatus, and a polishing information management system.

DESCRIPTION OF REFERENCE SYMBOLS

1 polishing pad
2 lower press platen
3 upper press platen
5 controller
6 communication unit
7 sensor
8 information storage module
9 memory
10 control IC (communication unit)
11 battery
W wafer

What is claimed is:

1. A polishing pad, including:

sensors;

a memory for storing detected information obtained by the sensors;

a power supply;

a communication circuit configured to communicate with outside in a non-contact manner;

a lifetime display; and an information storage module embedded in the polishing pad, wherein:

the memory, the power supply, and the communication circuit are provided in the information storage module, the sensors include at least one sensor embedded in the polishing pad and outside the information storage module, the information storage module assesses a lifetime of the polishing pad based on the detected information stored in the memory and displays a result of the lifetime assessment on the lifetime display, the sensors include at least one type to detect of a temperature, a pressure, and an acceleration, the information storage module counts up a total length of time when at least one of the temperature detected by the sensor, the pressure detected by the sensor and the acceleration detected by the sensor is equal to or larger than a given value to thereby measure hours of use in total of the polishing pad, and the information storage module assesses the lifetime based on whether the hours of use in total of the polishing pad are equal to or smaller than a predefined length of time.

2. The polishing pad as claimed in claim 1, wherein the memory stores therein a manufacturing history of the polishing pad and operational requirements of a polishing apparatus in addition to the detected information obtained by the sensors during a polishing process after the polishing pad is set in the polishing apparatus.

3. A polishing information management system, including:

the polishing pad as claimed in claim 1; and an outside wireless communication unit configured to communicate with the communication circuit of the polishing pad in a non-contact manner.

4. A polishing apparatus, comprising:

the polishing pad is the polishing pad as claimed in claim 1; and an outside wireless communication unit configured to communicate with the communication circuit of the polishing pad in a non-contact manner, wherein an object to be polished retained on a lower surface of an upper press platen and a polishing pad set on a lower press platen are pushed against each other under an applied pressure and slidably moved relative to each other to polish the object.

* * * * *